United States Patent [19]

Osgood

[11] 4,108,215

[45] Aug. 22, 1978

[54] CONTROL MECHANISM FOR GRIPPER SHUTTLES

[75] Inventor: John H. Osgood, Westboro, Mass.

[73] Assignee: Crompton & Knowles Corporation, New York, N.Y.

[21] Appl. No.: 734,142

[22] Filed: Oct. 20, 1976

[51] Int. Cl.[2] ..... D03D 47/24

[52] U.S. Cl. ..... 139/438; 139/185

[58] Field of Search ..... 139/185, 186, 187, 437, 139/438, 439

[56] References Cited

U.S. PATENT DOCUMENTS

| | | | |
|---|---|---|---|
| 1,956,076 | 4/1934 | Lindsjo | 139/185 |
| 3,487,860 | 1/1970 | Svaty | 139/185 |
| 3,875,974 | 4/1975 | Rambousek | 139/438 |

*Primary Examiner*—Henry S. Jaudon

[57] ABSTRACT

In gripper shuttle looms for a shuttle box which contains a groove for receiving a gripper shuttle and which rotates 180° to turn the shuttle around and has a braking member which cooperates with the groove to check the shuttle in the groove, and wherein said braking member moves away from the groove to permit the shuttle box to be turned and the shuttle to be picked: restraining means located in the groove for restraining the shuttle against lateral movement along the longitudinal axis of the groove during the shuttle box turning motion and which maintains the shuttle in the proper position in the shuttle box and allows the shuttle to be picked out of the shuttle box.

9 Claims, 9 Drawing Figures

CONTROL MECHANISM FOR GRIPPER SHUTTLES

BACKGROUND OF THE INVENTION

The present invention relates to improvements in receiving and control means for shuttles in looms, more particularly looms of the gripper shuttle type in which the shuttle is picked alternately from both sides of the loom. Each time that the shuttle is picked from one side of the loom it must be braked on the opposite side of the loom at a location within the shuttle receiving mechanism. The shuttle must then be precisely positioned at a predetermined location for a threading operation and for accurate picking out of the receiving mechanism. If the shuttle is not precisely positioned, the amount of force transmitted to the shuttle by the picking mechanism will vary and this will result in an inaccurate shuttle flight, which in some cases may be insufficient so that the shuttle will not make it all the way to the opposite side of the loom.

It has been known in the weaving art to positively position a shuttle which has been received into the shuttle box so that it is in a predetermined position for threading and picking. However, the mechanism for braking or checking the shuttle and for positioning the shuttle must be disengaged from the shuttle at the time of picking. Just prior to the time of picking, there exists a possibility of losing control of the shuttle whereby external forces may cause the shuttle to move out of the predetermined picking position. This problem is particularly acute in looms which operate with a shuttle box which is turned 180° after receiving the shuttle so that it can be picked out of the shuttle box to the opposite side of the loom. This type of loom is shown in the following U.S. patents to V. Svaty: No. 3,315,709 dated 25 Apr., 1967 and No. 3,330,305 dated 11 July, 1967 and No. 3,875,974 issued Apr. 8, 1975 to Rambousek. In the loom disclosed in these two U.S. patents, the gripper shuttle enters the shuttle box and is checked or braked. The filling which has been brought across the loom from the opposite side is disengaged and a new filling is inserted into the shuttle. The shuttle box is mounted on a turntable which is partially rotated after the new filling has been inserted into the shuttle box so that the shuttle is turned 180° so that the head of the shuttle points towards the end from which it came. At this point, the braking or checking mechanism is released from its checking function on the shuttle and the shuttle is propelled or picked out of the shuttle box. See, for example, the braking mechanism disclosed in the Svaty et al patent U.S. Pat. No. 3,487,860 dated 6 Jan., 1970. As is shown in this last patent, the braking pressure must be relieved before the shuttle is picked. It is at this point between the time the brake is released and before the shuttle is picked that there is a tendency for the shuttle to be moved out of position by the newly inserted filling which is under tension. Any slight movement of the shuttle at this point will pull it toward the shed away from the picking mechanism. This will result in a faulty pick.

The type of loom to which the present invention is applied further includes pneumatic means for picking the shuttle. The pneumatic means comprise a piston to which is attached a picking member which engages the end of the shuttle. If the shuttle is not properly positioned close to the end of the picking member, the end of the shuttle will be struck abruptly thereby producing a high initial acceleration which in turn causes the filling to break. In addition, there may be less than a full transfer of energy from the picking member to the shuttle so that the shuttle may not be picked entirely through the shed or boxed properly on the opposite side of the loom.

Further refinements to the loom disclosed in the above identified patents have included the addition of positioning mechanism which places the shuttle in the proper position after it has been checked. However, even this mechanism has to be disengaged from the shuttle before the shuttle is picked, thereby leaving the shuttle under the influence of the filling which has just been inserted into the shuttle.

SUMMARY OF THE INVENTION

It is the principle object of the present invention to overcome the disadvantages described above by providing control apparatus for looms operating with gripper shuttles in which the shuttle is braked or checked as it enters the shuttle box and positioned to the proper position for receiving a new filling and for picking. After the shuttle is positioned, the brake is released from its engagement with the shuttle to allow a shuttle box to be turned and the shuttle to be picked. The control means of the present invention comprises the addition of a restraining member within the shuttle box which exerts enough force to restrain the shuttle against sliding movement within the shuttle box in opposition to the tension of the newly inserted filling to maintain the shuttle in its proper position and yet which is sufficiently weak to allow the shuttle to be picked out of the shuttle box.

BRIEF DESCRIPTION OF THE DRAWINGS

The invention will be more clearly understood from the detailed description when read together with the drawings in which.

DESCRIPTION OF THE PREFERRED EMBODIMENT

Figure 6:
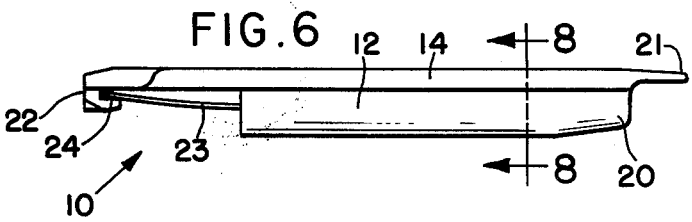
FIG. 6 is a front elevation of the gripper shuttle which is used with the present invention.
Figure 8:
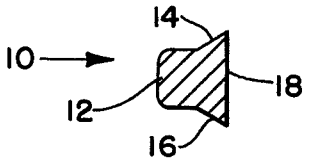
FIG. 8 is a vertical section of the shuttle taken along line 8—8 of FIG. 6 and looking in the direction of the arrows.

Referring to FIGS. 6 and 8, the gripper shuttle which is used with the present invention is generally indicated by the reference numeral 10 and comprises a main body 12, a slanted first slide face 14 on the top, an oppositely slanted second slide face 16 on the bottom and a third slide face 18 at the back. The front portion of the shuttle 10 has a projection 20. The leading end 21 of the shuttle 10 is pointed and the trailing end 22 has a flat spring 23 which is urged against a clamping surface 24 for clamping a filling therebetween.

Figure 4:
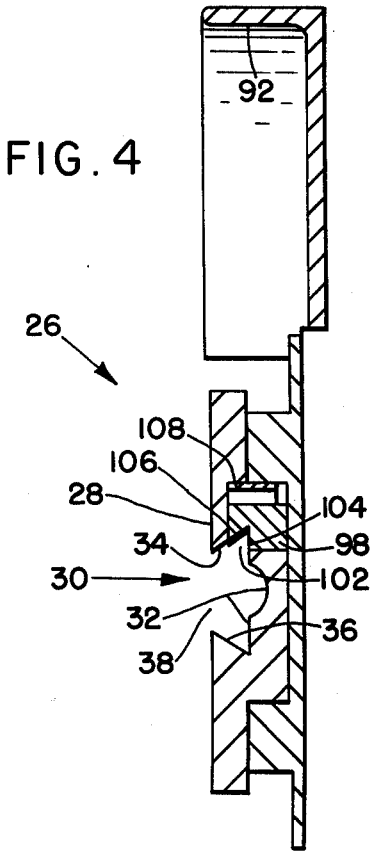
FIG. 4 is a vertical section taken along line 4—4 of FIG. 3, looking in the direction of the arrows and showing the shuttle box and restraining means for the shuttle.
Figure 5:
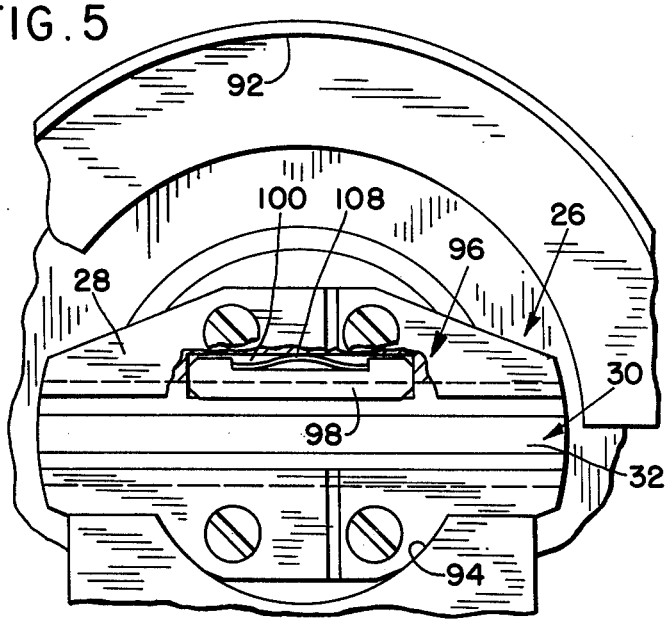
FIG. 5 is a fragmentary front elevation of the shuttle box with portions in section and illustrating the restraining means.

The means for receiving and controlling the shuttle 10 comprise a shuttle box generally indicated by the reference numeral 26, see particularly FIGS. 4 and 5. Shuttle box 26 comprises a generally flat front surface 28 which includes an elongated groove generally indicated at 30. Elongated groove 30 has a cross sectional configuration which is generally trapezoidal and comprises a back wall 32 forming the base of the trapezoid, upper and lower walls 34 and 36 which form the sides and which converge toward an opening 38 at the front surface 28. Groove 30 is designed for receiving the gripper shuttle 10 in a sliding fit whereby surfaces 14 and 16 of the shuttle slide on surfaces 34 and 36, respectively, of the groove and surface 18 slides on surface 32.

Figure 1:
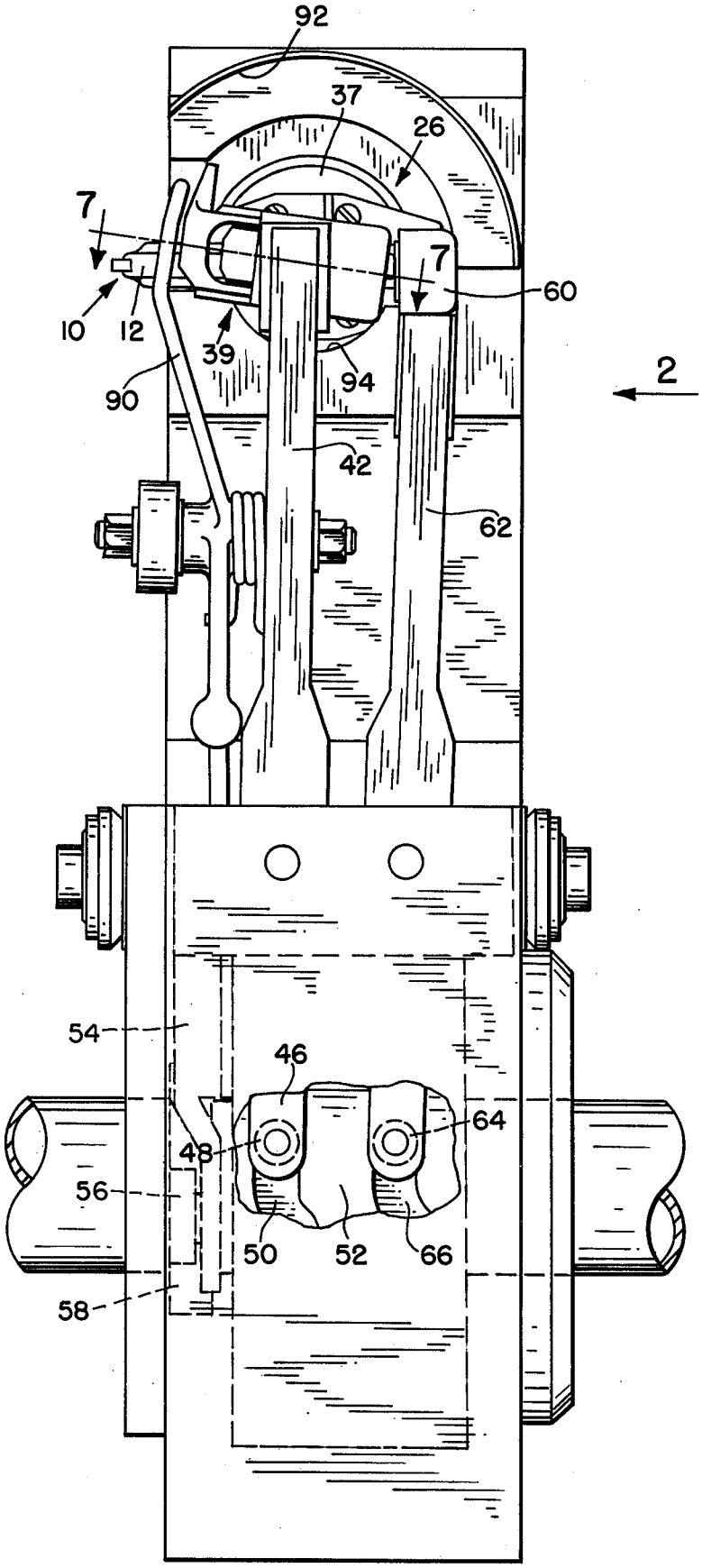
FIG. 1 is fragmentary front elevation illustrating the shuttle control apparatus of the present invention as applied to a rotary shuttle box and showing the shuttle in the fully boxed position.
Figure 2:
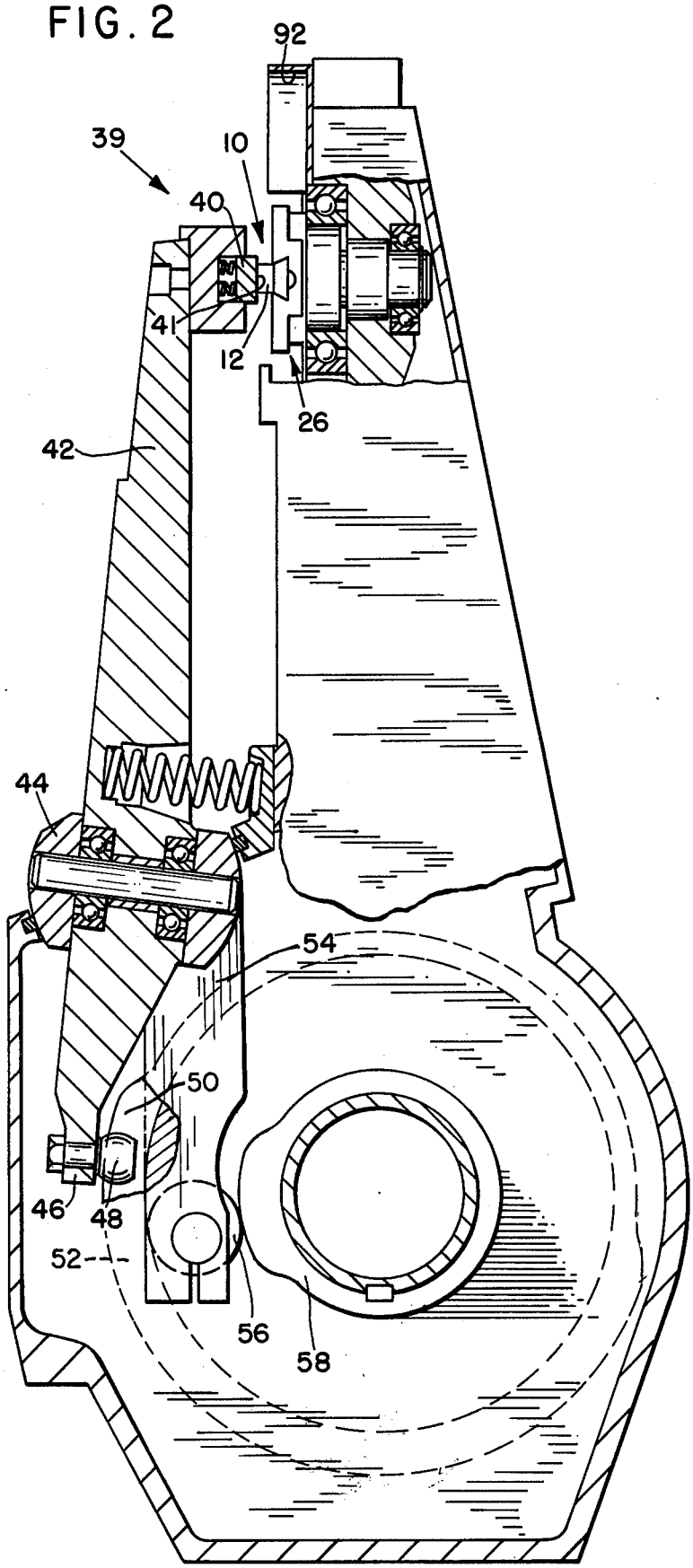
FIG. 2 is an end view looking in the direction of arrow 2 in FIG. 1, with portions broken away.

The shuttle receiving and control mechanism disclosed in the drawings is designed for application at the right hand side of the loom. It is to be understood that a similar mechanism will also be used at the left hand side of the loom but of opposite hand. Shuttle box 26 is rotatably mounted on a fixed structure 37. The loom to which the present invention is applied is shown in the above-identified U.S. patents. In the manner disclosed in these patents a shuttle 10 is picked to the left as viewed in FIG. 1, passes through the warp shed, enters the shuttle box on the opposite side of the loom, not shown, and is then picked in the opposite direction back into the shuttle box shown in FIG. 1. The leading end 21 of the shuttle enters the groove 30 of the shuttle box 26 with the trailing end 22 carrying the filling from the opposite side of the loom. This filling is then released and a new filling is inserted from the right side of the loom. The shuttle box 26 is rotated 180° so that the leading end 21 is now directed toward the left side of the loom. The shuttle 10 is then picked out of the shuttle box 26 towards the shuttle box located on the left side of the loom. The shuttle box 26 is thereafter rotated 180° in the opposite direction in readiness to receive the shuttle on its return flight from the left side of the loom.

Referring particularly to FIGS. 1, 2, 3 and 7, the mechanism for receiving and controlling the shuttle 10 comprises shuttle box 26 and a brake mechanism generally indicated by the reference numeral 39 and which includes a brake element 40 having a braking surface 41. Brake mechanism 39 is similar to and functions in the same manner as the brake mechanism disclosed in U.S. Pat. No. 3,875,974 to Rambousek, cited above. Brake element 40 is mounted on the upper end of a lever 42 which is mounted on a universal pivot 44 which permits movement of lever 42 toward and away from shuttle box 26 and also movement generally longitudinally of the groove 30. The lower end 46 of lever 42 has mounted thereon a follower 48 which rides in a groove 50 of a cam 52. Cam 52 is designed for moving brake mechanism 39 longitudinally of the groove 30. An intermediate lever 54 is also attached to the lower portion 46 of lever 42 and has attached thereto a follower 56. A cam 58 engages follower 56 and is effective to rock lever 42 so that brake element 40 moves toward and away from groove 30. A positioning element 60 is mounted on a lever 62 which also has controls similar to that of lever 42 for movement of positioning element 60 toward and away from the shuttle box 26 and also for movement generally longitudinally of the groove 30. This mechanism is not shown in complete detail, but it also has a lower cam follower indicated at 64 which rides in a groove 66 in cam 52. Lever 62 is also mounted in a universal pivot similar to pivot 44 so that it can also be moved toward and away from the shuttle box 26 by mechanism similar to lever 54, follower 56 and cam 58 which are used for controlling lever 42.

Figure 3:
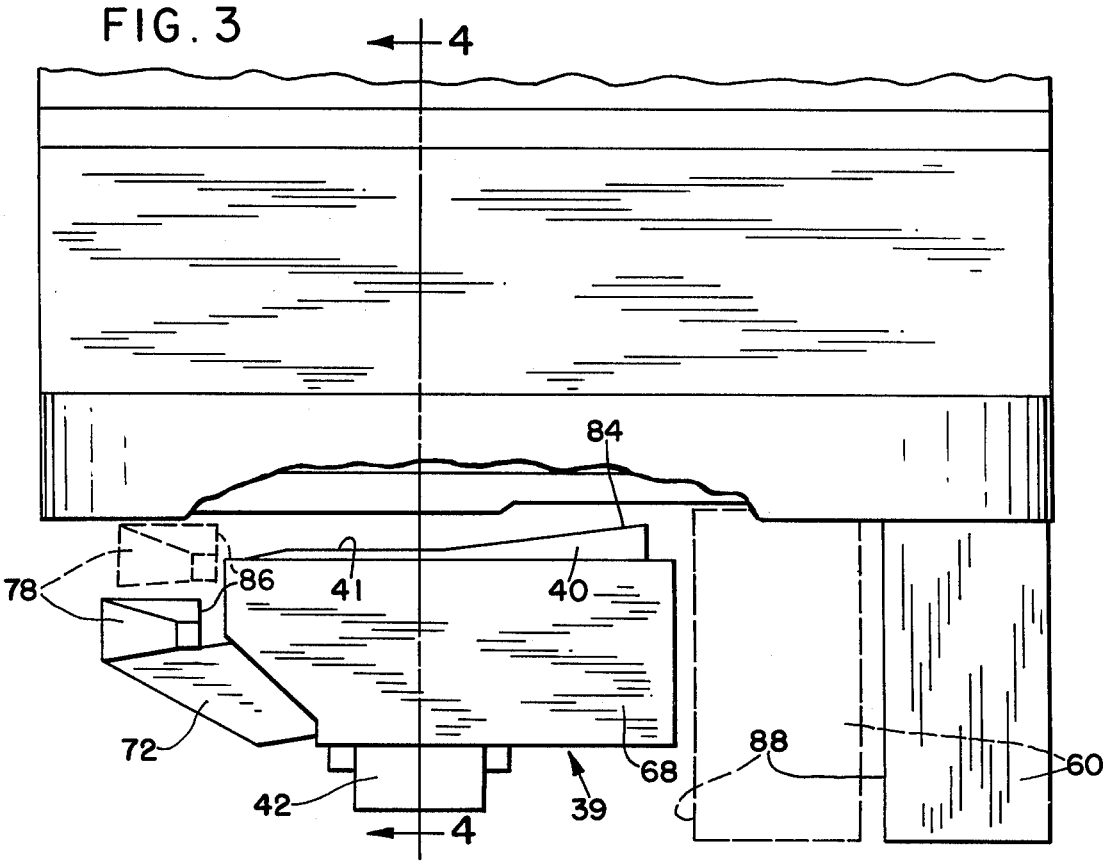
FIG. 3 is a plan view of the control apparatus shown in FIG. 1 prior to boxing of the shuttle.
Figure 7:
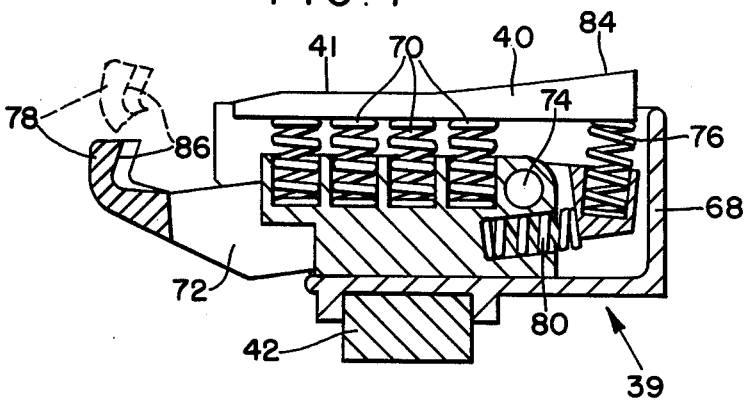
FIG. 7 is a horizontal section taken along line 7—7 of FIG. 1 of the shuttle braking member.

Referring particularly to FIGS. 3 and 7, brake element 40 is resiliently mounted in a housing 68 by means of springs 70. A lever 72 is pivotally mounted at 74 within housing 68. A spring 76 connects one end of lever 72 to one end of brake element 40. The opposite end of lever 72 contains a jaw 78 for a purpose to be described. A spring 80 maintains jaw 78 in an inactive position as shown in full lines in FIGS. 3 and 7. When the shuttle 10 approaches the shuttle box 26, brake element 40 is in its checking position adjacent the shuttle box as shown in FIG. 3. As the shuttle enters the box, projection 20 of the shuttle engages braking surface 41 of the brake which squeezes the shuttle against the back wall 32 of the shuttle box and thereby checks or brakes the shuttle. As the shuttle fully enters box 26 it strikes a portion 84 of braking surface 41 which tapers in toward groove 30 and causes the outer end of brake element 40 to be displaced within housing 68 to a greater extent than that of the opposite end of brake element 40 which is first engaged by the shuttle 10. The movement of the portion of brake element 40 which is adjacent surface portion 84 compresses spring 76 which in turn causes spring 80 to be compressed. This causes lever 72 to rock clockwise as viewed in FIG. 7 thereby causing jaw 78 to move toward the shuttle box to the dotted line position shown in FIGS. 3 and 7.

Figure 9:
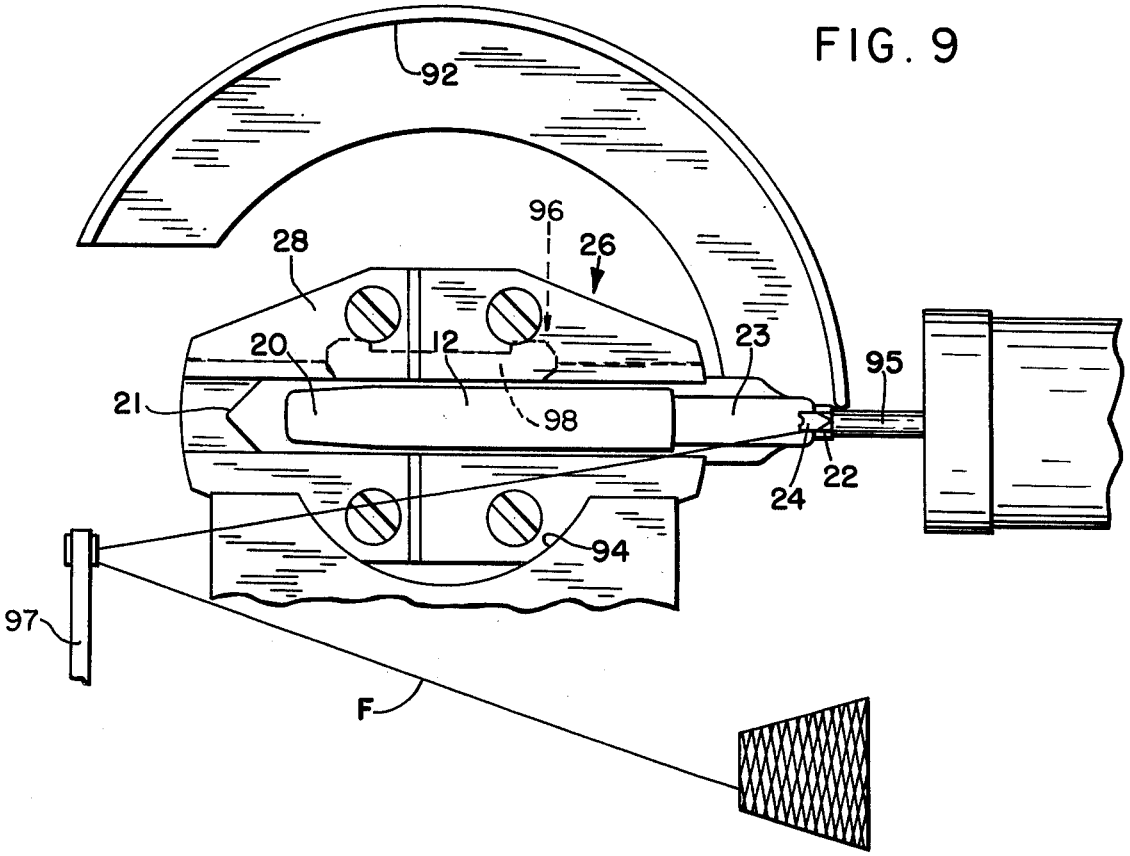
FIG. 9 is a fragmentary view of the shuttle box after it has been rotated 180° with the shuttle in position for picking.

Shortly after the shuttle is braked, positioning element 60 is moved toward the left to the dotted line position as viewed in FIG. 3 and engages the end of projection 20 which is adjacent leading end 21 of the shuttle 10. Element 60 continues to move toward the left and pushes the shuttle 10 against surface 86 of jaw 78 thereby effectively clamping the. shuttle between surface 86 and the inside surface 88 of positioning element 60. After the shuttle is so clamped, element 60 and jaw 78 are moved to the right as viewed in FIGS. 3 and 7 to position the shuttle to the proper threading and picking position. Details of the mechanism for positioning the shuttle have not been included in this application inasmuch as they are not novel to the present applicant. Details of the boxing of shuttles of the type shown in this application is illustrated and described in much more detail in U.S. Pat. No. 3,875,974. Therefore, further description of this mechanism and its operation is not necessary in this application and the text of said U.S. Patent is incorporated herein by reference. After the shuttle is so positioned, a lever 90, under the influence of a follower and cam, not shown, is moved toward the shuttle and engages spring 23 to release the filling which has just been carried through the shed from the opposite side of the loom. Subsequently, a new filling is inserted between clamping surface 24 and spring 23 by a threading member 97 in a manner fully disclosed in the patents identified above in the Background portion of this application. The shuttle box 26 is then rotated 180° to the position shown in FIG. 9 so that the leading end 21 of the shuttle is pointed toward the left hand side of the loom. During rotation of the shuttle, it is maintained in the proper position by stationary guideways 92 and 94. However, when it reaches the position shown in FIG. 9 the shuttle is free of guideways 92 and 94 to allow it to be picked by the picking member 95 out of the shuttle box to the other side of the loom. Prior to picking, brake element 40 is moved away from the shuttle box to allow the shuttle to be picked and since the shuttle is no longer guided in guideways 92 and 94 it is free to slide within groove 30. It is at this point that the newly threaded filling indicated at F which is under tension can shift the shuttle out of the proper picking position. The shuttle is maintained in the proper picking position by restraining means generally indicated by the reference numeral 96 located within shuttle box 26. The provision of restraining means 96 provides means for maintaining control over the position of the shuttle within the groove of the shuttle box when the checking and picking system releases the shuttle from its control. This provides a unique advantage over the mechanism of the patents referred to hereinabove in the Background section of this application. Restraining means 96 comprise an insert 98 located within a cavity 100 in upper surface 34. Insert 98 has a notch 102 formed by surfaces 104 and 106 which are, as shown in FIG. 4, contiguous with surfaces 32 and 34, respectively, of groove 30 when the shuttle 10 is located in the groove. A spring 108 located in cavity 100 urges insert 98 towards the lower surface 36 thereby exerting pressure on first slide face 14 of the shuttle when it is located within groove 30. This creates a slight drag on the shuttle 10 to restrain free-sliding motion of the shuttle within groove 30 and maintains the shuttle within the proper picking position just prior to picking.

I claim:

1. Shuttle control apparatus for looms operating with gripper shuttles comprising:

a. a shuttle box having an elongated opening along one side thereof and at least two generally opposed elongated surfaces extending inwardly from said elongated opening for guiding a shuttle therebetween;

b. a braking member movable toward and away from said opening;

c. means for moving said braking member toward said opening for engaging and braking a shuttle which enters said shuttle box and away from said opening for disengaging from said shuttle and thereby allowing said shuttle to be picked out of said shuttle box;

d. means for positioning a shuttle to a predetermined location within said shuttle box after it has been braked; and e. a restraining member extending along a portion of at least one of said elongated surfaces for restraining a shuttle against sliding movement between said surfaces to maintain it in said predetermined location after it has been positioned and which allows said shuttle to be picked out of said shuttle box.

2. Shuttle control apparatus as set forth in claim 1 wherein said elongated surfaces converge toward each other in the direction of said opening.

3. Shuttle control apparatus as set forth in claim 1 wherein said one elongated surface contains a cavity and said restraining member is located within said cavity and includes a restraining surface for engaging a shuttle located between said elongated surfaces.

4. Shuttle control apparatus as set forth in claim 3 wherein said restraining member is resiliently mounted within said cavity so that said restraining surface is biased toward a shuttle located between said elongated surfaces.

5. Gripper shuttle control apparatus comprising a. a rotating shuttle box comprising an elongated groove having a plurality of elongated surfaces for receiving a shuttle;

b. a braking member movable toward and away from said groove;

c. means for moving said braking member toward said groove for engaging and braking a shuttle which enters said shuttle box and away from said groove for disengaging from said shuttle and thereby allowing said shuttle to be picked out of said shuttle box;

d. means for positioning a shuttle to a predetermined location within said shuttle box after it has been braked; and e. a restraining member having a shuttle engaging surface located within at least one of said elongated surfaces of said groove for restraining a shuttle against sliding movement within said groove to maintain it in said predetermined location after it has been positioned and which allows said shuttle to be picked out of said shuttle box.

6. Shuttle control apparatus as set forth in claim 5 wherein the cross section of said groove comprises a base and two converging sides.

7. Shuttle control apparatus as set forth in claim 6 wherein said restraining member is located at the junction of said base and one of said sides.

8. Shuttle control apparatus as set forth in claim 6 wherein said groove has a cavity at the junction of said base and one of said sides and said restraining member is located within said cavity.

9. Shuttle control apparatus as set forth in claim 8 wherein said restraining member is resiliently mounted within said aperture so that said shuttle engaging surface is biased toward a shuttle located within said groove.

* * * * *